US007962279B2

(12) United States Patent
Pepitone et al.

(10) Patent No.: US 7,962,279 B2
(45) Date of Patent: Jun. 14, 2011

(54) METHODS AND SYSTEMS FOR ALERTING AN AIRCRAFT CREW MEMBER OF A POTENTIAL CONFLICT BETWEEN AIRCRAFT ON A TAXIWAY

(75) Inventors: David Pepitone, Sun City West, AZ (US); Edward Tomaszewski, Phoenix, AZ (US)

(73) Assignee: Honeywell International Inc., Morristown, NJ (US)

( * ) Notice: Subject to any disclaimer, the term of this patent is extended or adjusted under 35 U.S.C. 154(b) by 1026 days.

(21) Appl. No.: 11/754,709

(22) Filed: May 29, 2007

(65) Prior Publication Data

US 2010/0017105 A1 Jan. 21, 2010

(51) Int. Cl.
*G08G 5/06* (2006.01)

(52) U.S. Cl. ..... 701/120; 340/945; 340/961; 340/995.1; 701/300; 701/301; 701/302; 342/29; 342/30

(58) Field of Classification Search ..... None
See application file for complete search history.

(56) References Cited

U.S. PATENT DOCUMENTS 5,469,371 A * 11/1995 Bass ..... 358/474
5,689,273 A * 11/1997 Bailey et al. ..... 342/407
5,835,059 A * 11/1998 Nadel et al. ..... 342/398
6,118,401 A * 9/2000 Tognazzini ..... 342/29
6,246,342 B1 6/2001 Vandevoorde et al.
6,282,488 B1 * 8/2001 Castor et al. ..... 701/120
6,305,484 B1 * 10/2001 Leblanc ..... 180/167
6,462,697 B1 * 10/2002 Klamer et al. ..... 342/36
6,571,166 B1 * 5/2003 Johnson et al. ..... 701/120
6,690,295 B1 * 2/2004 De Boer ..... 340/951
6,690,299 B1 * 2/2004 Suiter ..... 340/973
6,694,249 B1 * 2/2004 Anderson et al. ..... 701/120
6,751,545 B2 * 6/2004 Walter ..... 701/120
6,862,519 B2 * 3/2005 Walter ..... 701/120
6,920,390 B2 * 7/2005 Mallet et al. ..... 701/120
7,050,909 B2 5/2006 Nichols et al.
7,230,632 B2 * 6/2007 Coldefy et al. ..... 345/619
7,379,014 B1 * 5/2008 Woodell et al. ..... 342/29
7,382,288 B1 * 6/2008 Wilson et al. ..... 340/972
7,385,527 B1 * 6/2008 Clavier et al. ..... 340/945
7,495,600 B2 * 2/2009 Rees et al. ..... 342/29
7,561,037 B1 * 7/2009 Monroe ..... 340/521
7,564,372 B1 * 7/2009 Bailey et al. ..... 340/961
7,589,644 B2 * 9/2009 Meunier ..... 340/945
7,605,688 B1 * 10/2009 Seah ..... 340/425.5

(Continued)

OTHER PUBLICATIONS

EP Search Report, EP08157023.6-2215/2001004 dated Nov. 26, 2010.

*Primary Examiner* — Jack Keith
*Assistant Examiner* — Jonathan M Dager
(74) *Attorney, Agent, or Firm* — Ingrassia Fisher & Lorenz, P.C.

(57) ABSTRACT

Methods and system are provided for alerting an aircraft crew member of a potential conflict between a first aircraft and a second aircraft on a first taxiway. Real-time positioning data related to the first aircraft on the first taxiway is monitored. Data related to real-time positioning of the second aircraft is monitored. A prediction is made as to whether the second aircraft will enter the first taxiway, based on the monitored data related to real-time positioning of the second aircraft. The potential conflict is indicated on the first taxiway, if a prediction is made that the second aircraft will enter the first taxiway.

7 Claims, 4 Drawing Sheets

U.S. PATENT DOCUMENTS

| | | | | |
|---|---|---|---|---|
| 7,668,628 | B1 * | 2/2010 | Carrico | 701/9 |
| 7,737,867 | B2 * | 6/2010 | Arthur et al. | 340/980 |
| 2002/0039070 | A1 * | 4/2002 | Ververs et al. | 340/901 |
| 2002/0145079 | A1 * | 10/2002 | Burley | 244/114 R |
| 2003/0009278 | A1 * | 1/2003 | Mallet et al. | 701/120 |
| 2003/0033084 | A1 * | 2/2003 | Corcoran, III | 701/301 |
| 2003/0045994 | A1 * | 3/2003 | Stratton et al. | 701/120 |
| 2003/0074128 | A1 | 4/2003 | Mardirossian | |
| 2003/0122666 | A1 | 7/2003 | John et al. | |
| 2003/0135327 | A1 * | 7/2003 | Levine et al. | 701/220 |
| 2003/0160708 | A1 * | 8/2003 | Knoop | 340/958 |
| 2004/0006412 | A1 * | 1/2004 | Doose et al. | 701/10 |
| 2004/0056952 | A1 * | 3/2004 | Konya | 348/117 |
| 2004/0059497 | A1 * | 3/2004 | Sankrithi | 701/120 |
| 2004/0130479 | A1 | 7/2004 | Lo et al. | |
| 2005/0015202 | A1 | 1/2005 | Poe et al. | |
| 2005/0190079 | A1 * | 9/2005 | He | 340/945 |
| 2005/0192738 | A1 | 9/2005 | Conner et al. | |
| 2005/0283305 | A1 * | 12/2005 | Clark et al. | 701/120 |
| 2006/0007035 | A1 * | 1/2006 | Corrigan | 342/29 |
| 2006/0214816 | A1 * | 9/2006 | Schell | 340/961 |
| 2006/0259232 | A1 | 11/2006 | Huthoefer et al. | |
| 2007/0067093 | A1 * | 3/2007 | Pepitone | 701/120 |
| 2007/0080848 | A1 * | 4/2007 | Stone et al. | 342/30 |
| 2007/0168111 | A1 * | 7/2007 | Dubourg | 701/120 |
| 2007/0241935 | A1 * | 10/2007 | Pepitone et al. | 340/958 |
| 2007/0241936 | A1 * | 10/2007 | Arthur et al. | 340/958 |
| 2007/0260364 | A1 * | 11/2007 | Dwyer | 701/3 |
| 2008/0042880 | A1 * | 2/2008 | Ramaiah et al. | 340/958 |

* cited by examiner

METHODS AND SYSTEMS FOR ALERTING AN AIRCRAFT CREW MEMBER OF A POTENTIAL CONFLICT BETWEEN AIRCRAFT ON A TAXIWAY

TECHNICAL FIELD

The inventive subject matter generally relates to aircraft and taxiways, and more particularly, to methods and systems for alerting an aircraft crew member of a conflict between aircraft on a taxiway.

BACKGROUND

Air traffic, both private and commercial, continues to increase. With this increase, there has been a concomitant increase in the likelihood of runway conflicts. Efforts are thus being made to increase aircraft flight crew situational awareness during ground operations. As part of this effort, a format for airport surface map databases has been developed that can be used to render maps that include runways, taxiways, and/or apron elements on one or more flight deck displays. Although quite useful in providing data for rendering airport surface maps, the database does not provide any information regarding potential conflicts between aircraft that may occupy a single taxiway.

Accordingly, it is desirable to provide a method and a system that will display runways, taxiways, and/or apron elements, and that will provide sufficient position and/or orientation information to the flight crew. Additionally, it is desirable to have a method and a system that indicates whether a potential conflict exists on a taxiway between the positions of two aircraft. Furthermore, other desirable features and characteristics of the inventive subject matter will become apparent from the subsequent detailed description and the appended claims, taken in conjunction with the accompanying drawings and this background.

BRIEF SUMMARY

Methods and systems are provided for alerting an aircraft crew member of a conflict between aircraft on a taxiway.

In an embodiment of a method, by way of example only, data related to real-time positioning of the first aircraft on the first taxiway is monitored. Data related to real-time positioning of the second aircraft is monitored. A prediction is made as to whether the second aircraft will enter the first taxiway, based on the monitored data related to real-time positioning of the second aircraft. The potential conflict is indicated on the first taxiway, if the prediction is made that the second aircraft will enter the first taxiway.

In another embodiment, by way of example only, a system includes a processing system adapted to monitor data related to real-time positioning of the first aircraft on the first taxiway, to monitor data related to real-time positioning of the second aircraft, to make a prediction as to whether the second aircraft will enter the first taxiway, based on the monitored data related to real-time positioning of the second aircraft, and to produce and supply display commands indicating the potential conflict on the first taxiway, in response to the prediction that is made that the second aircraft will enter the first taxiway.

In another embodiment, by way of example only, a flight deck display system includes a processing system and a display device. The processing system is adapted to monitor data related to real-time positioning of the first aircraft on the first taxiway, to monitor data related to real-time positioning of the second aircraft, to make a prediction as to whether the second aircraft will enter the first taxiway, based on the monitored data related to real-time positioning of the second aircraft, and to produce and supply image rendering display commands indicating the potential conflict on the first taxiway, in response to a prediction that is made that the second aircraft will enter the first taxiway. The display device is coupled to receive the image rendering display commands and is operable, in response thereto, to render at least the first taxiway, the first aircraft, and the second aircraft and to selectively display the potential conflict on the first taxiway.

BRIEF DESCRIPTION OF THE DRAWINGS

The inventive subject matter will hereinafter be described in conjunction with the following drawing figures, wherein like numerals denote like elements, and wherein.

DETAILED DESCRIPTION OF THE INVENTIVE SUBJECT MATTER

Figure 1:
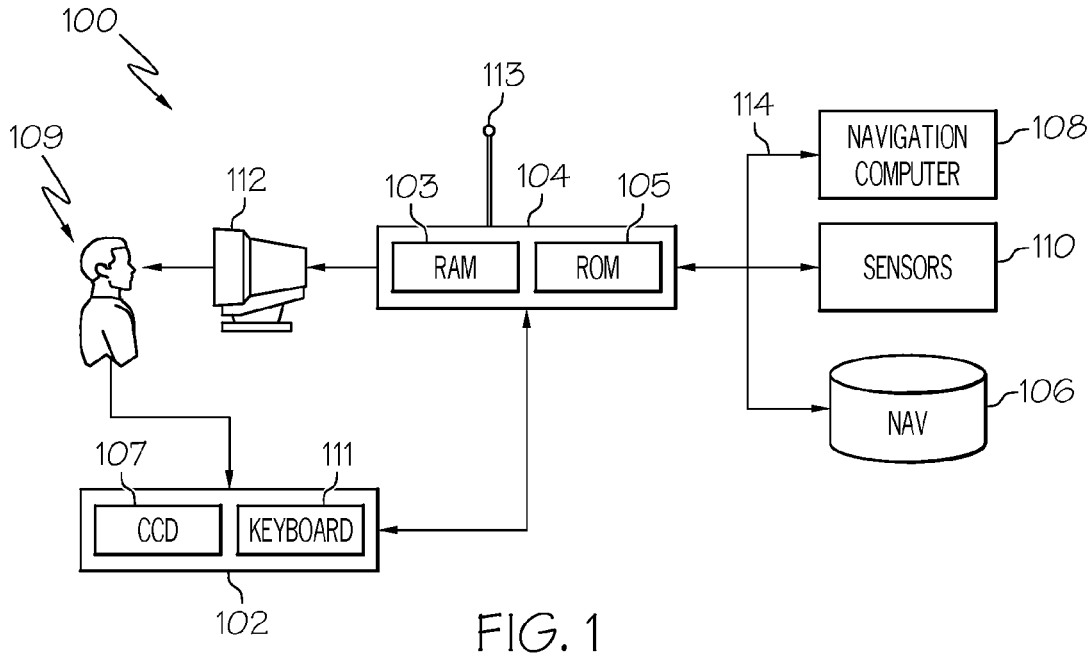
FIG. 1 is a functional block diagram of a flight deck display system for alerting an aircraft crew member of a conflict between aircraft on a taxiway, according to an embodiment.

The following detailed description is merely exemplary in nature and is not intended to limit the inventive subject matter or the application and uses of the inventive subject matter. Furthermore, there is no intention to be bound by any expressed or implied theory presented in the preceding technical field, background, brief summary or the following detailed description. In this regard, the inventive subject matter may be described in terms of functional block diagrams and various processing steps. It should be appreciated that such functional blocks may be realized in many different forms of hardware, firmware, and/or software components configured to perform the various functions. For example, the inventive subject matter may employ various integrated circuit components, e.g., memory elements, digital signal processing elements, look-up tables, and the like, which may carry out a variety of functions under the control of one or more microprocessing systems or other control devices. Such general techniques are known to those skilled in the art and are not described in detail herein. Moreover, it should be understood that the exemplary process illustrated may include additional or fewer steps or may be performed in the context of a larger processing scheme. Furthermore, the various methods presented in the drawing Figures or the specification are not to be construed as limiting the order in which the individual processing steps may be performed. It should be appreciated that the particular implementations shown and described herein are illustrative of the inventive subject matter and its best mode and are not intended to otherwise limit the scope of the inventive subject matter in any way.

Turning now to FIG. 1, a flight deck display system 100 for alerting an aircraft crew member of a conflict between aircraft on a taxiway is depicted, according to an embodiment. The system 100 includes at least a user interface 102, a processing system 104, one or more navigation databases 106, a navigation computer 108, various sensors 110, and one or more display devices 112. The user interface 102 is in operable communication with the processing system 104 and is configured to receive input from a user 109 (e.g., a pilot) and, in response to the user input, supply command signals to the processing system 104. The user interface 102 may be any one, or combination, of various known user interface devices including, but not limited to, a cursor control device (CCD), such as a mouse, a trackball, or joystick, and/or a keyboard, one or more buttons, switches, or knobs. In the depicted embodiment, the user interface 102 includes a CCD 107 and a keyboard 111. The user 109 uses the CCD 107 to, among other things, move a cursor symbol on the display screen, and may use the keyboard 111 to, among other things, input various data.

The processing system 104 is in operable communication with the navigation computer 108 and the display device 112 via, for example, a communication bus 114. The processing system 104 is coupled to receive various types of data from the navigation computer 108 and may additionally receive navigation data from one or more of the navigation databases 106, and is further coupled to receive various types of inertial data from the various sensors 110, and is operable to supply appropriate display commands to the display device 112 that cause the display device 112 to render various images. As will be described in more detail further below, the various images include images of various aircraft pathways, such as taxiways, runways, and aprons, of various airports.

The processing system 104 may additionally be coupled to a transceiver 113 to receive various data from one or more other external systems. For example, the processing system 104 may also be in operable communication with a source of weather data, a terrain avoidance and warning system (TAWS), a traffic and collision avoidance system (TCAS), an instrument landing system (ILS), and a runway awareness and advisory system (RAAS), just to name a few. In an embodiment, the processing system 104 may also be in operable communication to receive data or signals related to other aircraft close by, including, but not limited to, global positioning data from a global positioning system (GPS) and automatic dependent surveillance-broadcast systems (ADS-B). If the processing system 104 is in operable communication with one or more of these external systems, it will be appreciated that the processing system 104 is additionally configured to supply appropriate display commands to the display device 112 so that the data supplied from these external systems may also be selectively displayed on the display device 112.

The processing system 104 may include one or more microprocessing systems, each of which may be any one of numerous known general-purpose microprocessing systems or application specific processing systems that operate in response to program instructions. In the depicted embodiment, the processing system 104 includes RAM (random access memory) 103 and ROM (read only memory) 105. The program instructions that control the processing system 104 may be stored in either or both the RAM 103 and the ROM 105. For example, the operating system software may be stored in the ROM 105, whereas various operating mode software routines and various operational parameters may be stored in the RAM 103. It will be appreciated that this is merely exemplary of one scheme for storing operating system software and software routines, and that various other storage schemes may be implemented. It will also be appreciated that the processing system 104 may be implemented using various other circuits, not just one or more programmable processing systems. For example, digital logic circuits and analog signal processing circuits could also be used.

The navigation databases 106 include various types of navigation-related data. These navigation-related data include various flight plan related data such as, for example, waypoints, distances between waypoints, headings between waypoints, navigational aids, obstructions, special use airspace, political boundaries, communication frequencies, aircraft approach information, protected airspace data, and data related to different airports including, for example, data representative of published aeronautical data, data representative of airport maps, including altitude data, data representative of fixed airport obstacles (towers, buildings, and hangars), various data representative of various aircraft pathways (e.g., taxiways, runways, apron elements, etc.), data representative of various airport identifiers, data representative of various aircraft pathway identifiers, data representative of various aircraft pathway width and length values, data representative of the position and altitude of various aircraft pathways, various aircraft pathway survey data, including runway and taxiway center point, runway and taxiway centerline, and runway and taxiway endpoints, just to name a few. It will be appreciated that, although the navigation databases 106 are, for clarity and convenience, shown as being stored separate from the processing system 104, all or portions of these databases 106 could be loaded into the on-board RAM 103, or integrally formed as part of the processing system 104, and/or RAM 103, and/or ROM 105. The navigation databases 106, or data forming portions thereof, could also be part of one or more devices or systems that are physically separate from the display system 100.

The navigation computer 108 is in operable communication, via the communication bus 114, with various data sources including, for example, the navigation databases 106. The navigation computer 108 is used, among other things, to allow the pilot 109 to program a flight plan from one destination to another, and to input various other types of flight-related data. The flight plan data may then be supplied, via the communication bus 114, to the processing system 104 and, in some embodiments, to a non-illustrated flight director. In the depicted embodiment, the navigation computer 108 is additionally configured to supply, via the communication bus 114, data representative of the current flight path and the aircraft category to the processing system 104. In this regard, the navigation computer 108 receives various types of data representative of the current aircraft state such as, for example, aircraft speed, altitude, position, and heading, from one or more of the various sensors 110. The navigation computer 108 supplies the programmed flight plan data, the current flight path data, and, when appropriate, the aircraft category to the processing system 104, via the communication bus 114. The processing system 104 in turn supplies appropriate display commands to one or more of the display device 112 so that the programmed flight plan, or at least portions thereof, and the current flight path may be displayed, either alone or in combination, on the display device 112. As was noted above, the processing system 104 also receives various types of data, either directly or indirectly, and in turn supplies appropriate display commands to the display device 112. It will be appreciated that at least a portion of these received data may be simultaneously displayed on the display device 112 with the flight plan and/or current flight path. It will additionally be appreciated that all or portions of the data mentioned herein may be entered manually by a user, such as the pilot 109.

The display device 112 is used to display various images and data, in both a graphical and a textual format, and to supply visual feedback to the user 109 in response to the user input commands supplied by the user 109 via the user interface 102. It will be appreciated that the display device 112 may be any one of numerous known displays suitable for rendering image and/or text data in a format viewable by the user 109. Non-limiting examples of such displays include various cathode ray tube (CRT) displays, and various flat panel displays such as, various types of LCD (liquid crystal display) and TFT (thin film transistor) displays. The display may additionally be based on a panel mounted display, a HUD projection, or any known technology. In an exemplary embodiment, the display device 112 includes a panel display. It will additionally be appreciated that the display device 112 may be implemented as either a primary flight display (PFD) or a multi-function display (MFD). Preferably, however, the display device 112 is implemented as a MFD. To provide a more complete description of the method that is implemented by the display system 100, a general description of the display device 112 and its layout will now be provided.

Figure 2:
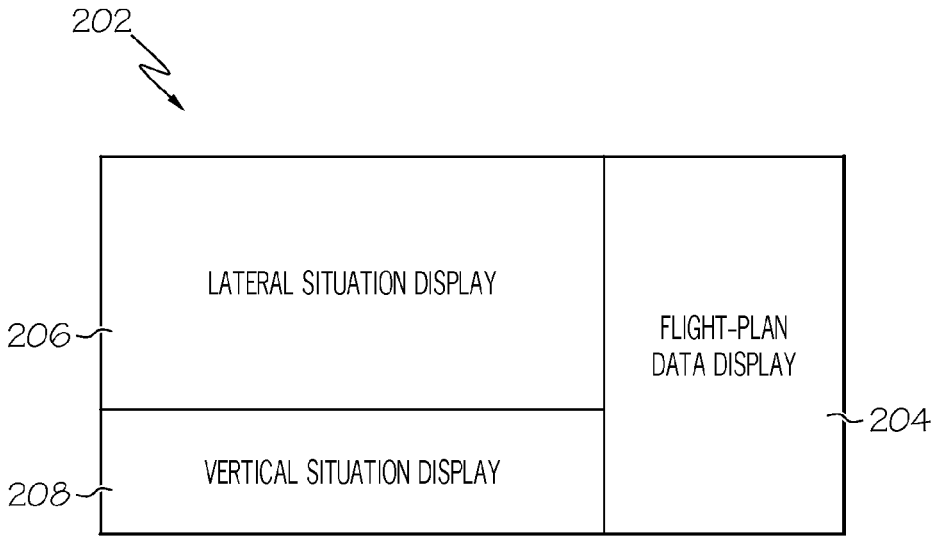
FIG. 2 is a simplified representation of a display screen that may be used in the system of FIG. 1, according to an embodiment.

With reference to FIG. 2, the display device 112 includes a display area 202 in which multiple graphical and textual images may be simultaneously displayed, preferably in different sections of the display area 202. For example, the display device may display, in various sections of its display area 202, a flight-plan data display 204, a lateral situation display 206, and a vertical situation display 208, simultaneously, alone, or in various combinations. The flight-plan data display 204 provides a textual display of various types of data related to the flight plan of the aircraft. Such data includes, but is not limited to, the flight identifier, and a waypoint list and associated information, such as bearing and time to arrive, among other things. It will be appreciated that the flight-plan data display 204 may additionally include various types of data associated with various types of flight hazards.

The lateral situation display 206 provides a two-dimensional lateral situation view or orthographic view of the aircraft along the current flight path, and the vertical situation display 208 provides either a two-dimensional profile vertical situation view or a perspective vertical situation view of the aircraft along the current flight path and/or ahead of the aircraft. While not depicted in FIG. 2, the lateral situation display 206 and the vertical situation display 208 may each selectively display various features including, for example, a top-view aircraft symbol and a side-view aircraft symbol, respectively, in addition to various symbols representative of the current flight plan, various navigation aids, and various map features below and/or ahead of the current aircraft position such as, for example, terrain, navigational aids, airport runways, airport taxiways, airport aprons, and political boundaries. It will be appreciated that the lateral situation display 206 and the vertical situation display 208 preferably use the same scale so that the pilot can easily orient the present aircraft position to either section of the display area 202. It will additionally be appreciated that the processing system 104 may implement any one of numerous types of image rendering methods to process the data it receives from the navigation databases 106 and/or the navigation computer 108 and render the views displayed therein.

It was noted above that the flight-related data 204, the lateral situation display 206, and the vertical situation display 208 may be displayed either alone or in various combinations. It is additionally noted that all or portions of the information displayed in the flight-plan data display 204, the lateral display 206, and/or the vertical situation display 206 could instead or additionally be displayed on one or more other non-illustrated display devices. Hence, before proceeding further with the description, it should be appreciated that, for clarity and ease of explanation and depiction, in each of the figures referenced below only the lateral situation display 206 is shown being displayed in the display area 202 of the display device 112.

Figure 3:
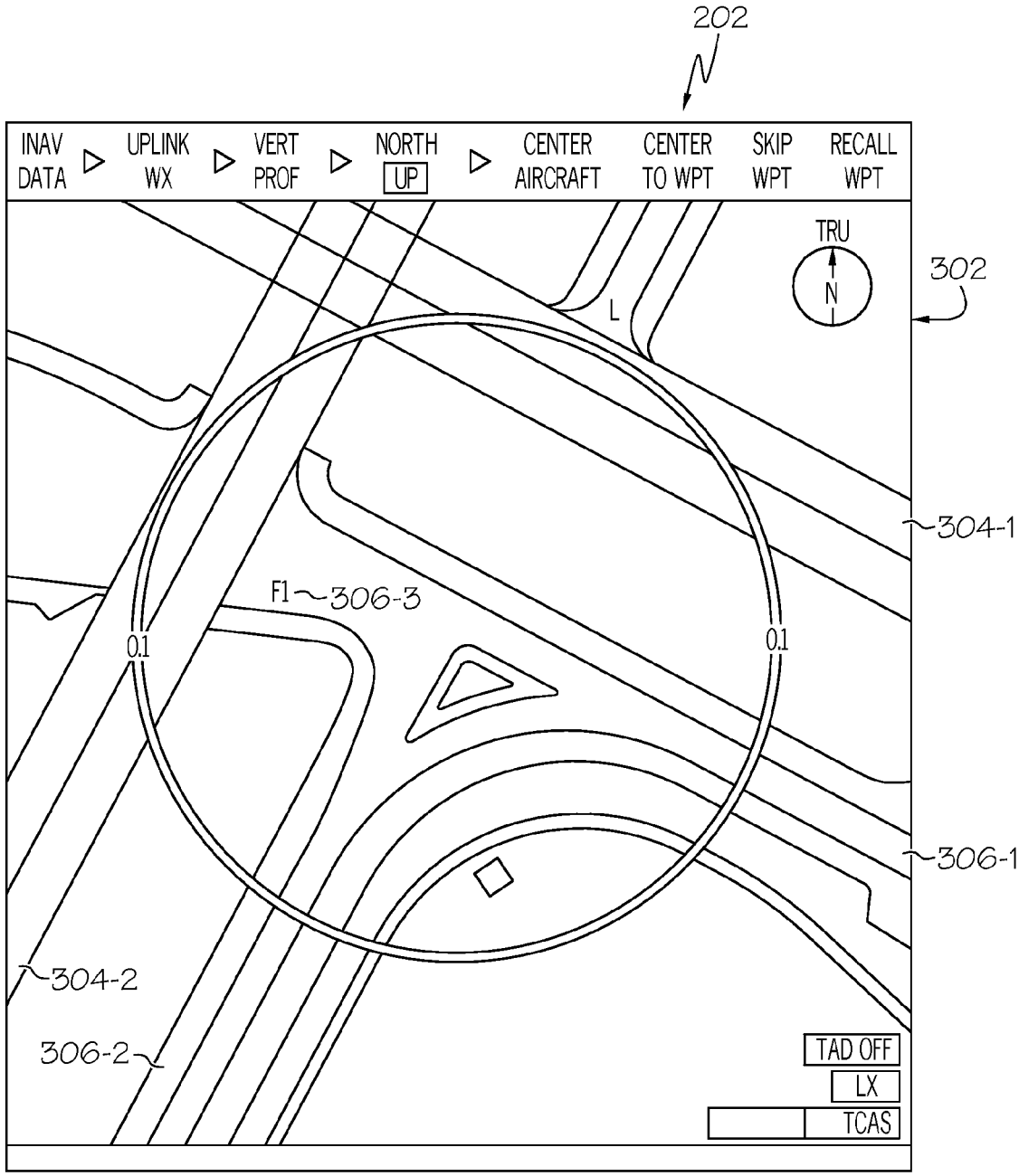
FIG. 3 is a display screen that depicts a lateral situation view of an airport map, according to an embodiment.

Returning now to the description, as was previously noted, the processing system 104 receives various types of airport-related data from the navigation database 106 and various types of data from the various sensors 110 and supplies image rendering display commands to the display device 112. As shown in FIG. 3, the image rendering display commands supplied from the processing system 104 cause the lateral situation display 206, in addition to or instead of one or more of the features previously mentioned, to render a two-dimensional lateral situation view of at least portions of an airport map 302. Alternatively, although not shown, the processing system 104 can be configured to supply image rendering display commands that additionally, or instead, cause the vertical situation display 208 to render a perspective view of at least portions of the airport map 302. As is generally known, the airport map 302 typically includes various aircraft pathways, which may include one or more runways 304 (e.g., 304-1, 304-2), one or more taxiways 306 (e.g., 306-1, 306-2, 306-3), and various other runway displaced airport features such as, for example, one or more non-illustrated apron elements.

Figure 4:
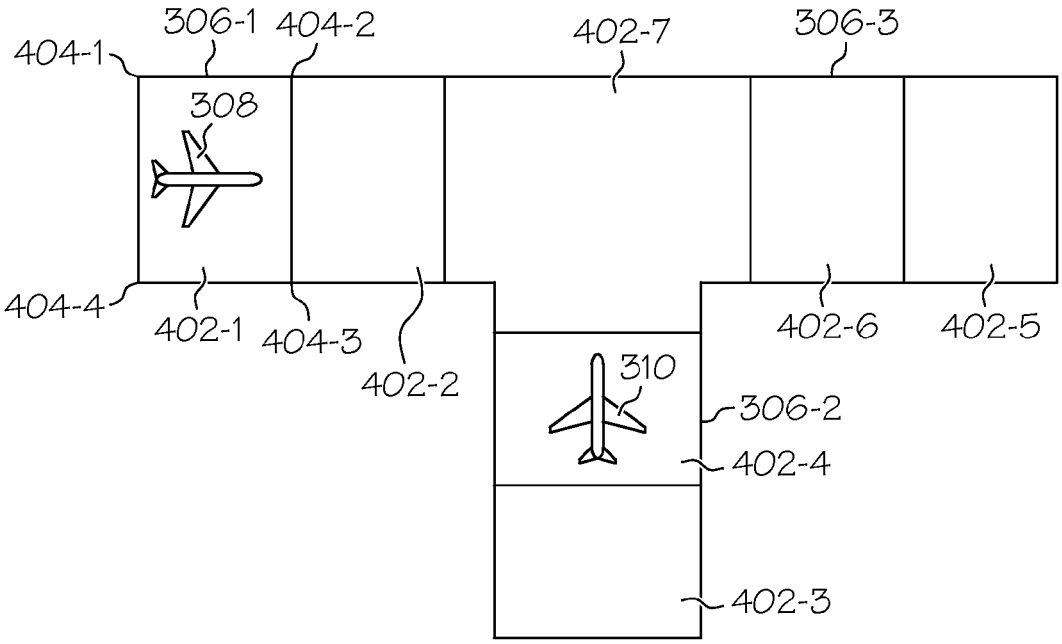
FIG. 4 is a simplified representation of two aircraft and a plurality of taxiways, according to an embodiment.

Turning now to FIG. 4, a simplified, close-up view of a portion of the airport map 302 including taxiways 306-1, 306-2, 306-3 and aircraft 308, 310 is shown. In an embodiment, the airport map 302 may be depicted in the form of individual sections (or segments) for some objects, and in the form of data representative of lines for other objects. The individual segments may take any one of numerous forms, such as the form of a polygon. Typically, and as shown more clearly in simplified form in FIG. 4, the aircraft pathways, such as the depicted taxiways 306 (e.g., 306-1, 306-2, 306-3), are divided into, and defined by, a plurality of such individual polygonal segments 402 (e.g., 402-1, 402-2, 402-3, 402-4, 402-5, 402-6, 402-7), and more particularly by a plurality of points, or nodes 404 (404-1, 404-2, 404-3, 404-4). Thus, the airport map data stored in the navigation databases 106 includes data representative of the plurality of nodes 404 that define the individual polygonal sections 402 of the taxiways 306 (and various other aircraft pathways) such as, for example, latitude and longitude information associated with each node 404 for accurately displaying the individual polygonal sections 402. It will be appreciated that the nodes 404 could also be represented in other formats, such as different units, or as relative values from a specific position. In an embodiment, the nodes 404 define each start and each end of the individual polygonal segments 402. In another embodiment, each segment 402 defines a block of a taxiway 306 having a single ingress and a single egress, such as segments 402-1 to 402-6. For clarity of illustration, only the four nodes 404 that define segment 402-1, and partially define segment 402-2, are provided with reference numerals.

Figure 5:
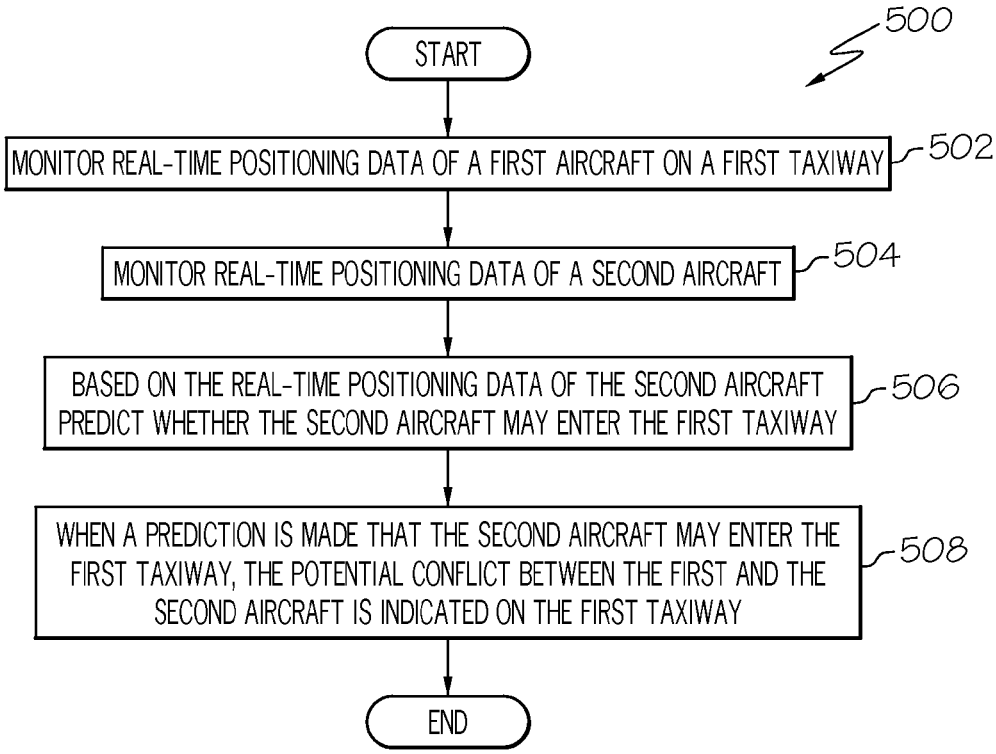
FIG. 5 is a flowchart depicting a method for alerting an aircraft crew member of a conflict between aircraft on a taxiway, according to an embodiment.

The system 100 described above may be used for alerting an aircraft crew member of a conflict between aircraft on a taxiway. A flow diagram for a method 500 to do so is depicted in FIG. 5. The method 500, according to an embodiment, includes monitoring real-time positioning data related to a first aircraft 308 on the first taxiway 306-1, step 502. The method 500 may also include monitoring the real-time positioning of the second aircraft 310, step 504. Based on the real-time positioning of the second aircraft 310, a prediction is made as to whether the second aircraft 310 will enter the first taxiway 306-1, step 506. If a prediction is made that the second aircraft 310 will enter the first taxiway 306-1, the potential conflict between the first and the second aircraft 308, 310 is indicated on the first taxiway, step 508. Each of these steps will now be discussed in more detail.

As mentioned above, the real-time positioning data of the first aircraft 308 on the first taxiway 306-1 is monitored, step 502. The real-time positioning data of the first aircraft 308 may include global positioning data, ground speed data, velocity data, track and turn rate data, acceleration data, heading or direction data, or any other data related to location and movement of the first aircraft 308. In an embodiment, the processing system 104 is adapted to receive the real-time positioning data from the navigation computer 108. Because the real-time positioning data is dynamic and may change over time, the processing system 104 may be adapted to update the location of the first aircraft 308 over time. In response to the received real-time positioning data, the processing system 104 may supply appropriate display commands to one or more of the display device 112 to thereby display the first aircraft 308 on the airport map 302. If the received data indicates that the first aircraft 308 is on the first taxiway 306-1, the first aircraft 308 is depicted on the airport map 302 accordingly. In an embodiment, the processing system 104 may be further adapted to identify a segment of the first taxiway 306-1 on which the first aircraft 308 is located and associate the identified segment therewith. The segment may be identified by identifying which nodes the first aircraft 308 is located between and assigning a segment defined by the nodes to the first aircraft 308. For example, if the first aircraft 308 is located between nodes 404-1 to 404-4, as depicted in FIG. 4, then segment 402-1 is associated with the first aircraft 308.

The real-time positioning of the second aircraft 310 is monitored, step 504. The real-time positioning data of the second aircraft 310 may be broadcasted to the first aircraft 308 either from the ADS-B system or from a GPS system on board the second aircraft 310. The real-time positioning data may include global positioning data, ground speed data, velocity data, track and turn rate data, or any other data related to location and movement of the second aircraft 310. Because the real-time positioning data is dynamic and may change over time, the processor 104 may be adapted to update the location of the second aircraft 310 over time. In response to the received real-time positioning data, the processing system 104 may produce and supply appropriate display commands to one or more of the display device 112 to thereby display the second aircraft 310 on the airport map 302. For example, if the received data indicates that the second aircraft 310 is on the second taxiway 306-2, the second aircraft 310 is depicted on the airport map 302 accordingly. In another embodiment, the processing system 104 may be adapted to identify a segment of the second taxiway 306-2 on which the second aircraft 310 is positioned and associate the segment therewith. The segment may be identified by identifying which nodes the second aircraft 310 is positioned between and assigning a segment defined by the nodes to the second aircraft 310. If the second aircraft 310 is located between nodes that define segment 402-4, as shown in FIG. 4, then segment 402-4 is associated with the second aircraft 310.

A prediction is made as to whether the second aircraft 310 will enter the first taxiway 306-1, based on the monitored real-time positioning data of the second aircraft 310, step 506. In an embodiment, a prediction may be made that the second aircraft 310 will enter the first taxiway 306-1 when the real-time positioning data of the second aircraft indicates the second aircraft 310 is positioned on a segment that is the same segment on which the first aircraft 308 is located, or the second aircraft 310 is positioned on a segment and the real-time positioning data indicates that the second aircraft 310 is traveling on a predicted path toward a segment on which the first aircraft 308 is located or that the heading of the second aircraft 310 is toward a segment on which the first aircraft 308 is located. When a prediction is made that the second aircraft 310 will enter the first taxiway 306-1, a "potential conflict" may be considered to exist between the first aircraft 308 and the second aircraft 310.

For example, the processing system 104 may compare the segment on which the first aircraft 308 is located and the segment on which the second aircraft 310 is positioned and may determine a potential conflict exists, if the segment on which the first aircraft 308 is located and the segment on which the second aircraft 310 is positioned are located relative to each other such that the first aircraft 308 is not provided with an egress from the first taxiway 306-1. In another example, the processing system 104 may determine that the monitored data indicates the second aircraft 310 is occupying a segment that is not adjacent to the segment 402-1 associated with the first aircraft 308 or that do not have two nodes in common. In this case, if segments between the segment associated with the first aircraft (e.g., segment 402-1) and the segment associated with the second aircraft 310 (e.g., segment 402-7) are located such that the first aircraft 308 is not provided with at least one egress from the first taxiway 306-1, then a determination is made that a potential conflict may exist on the first taxiway 306-1.

In another embodiment, a prediction may be made that the second aircraft 310 will enter the first taxiway 306-1, when the monitored real-time positioning data of the second aircraft 310 indicates that the second aircraft 310 is occupying a taxiway segment 402 that is the same as the segment 402-1 with which the first aircraft 308 is associated. For example, the processing system 104 may determine that the monitored data indicates the second aircraft 310 is occupying a taxiway segment 402 that is the same as the segment 402-1 with which the first aircraft 308 is associated, such as segment 402-1. The processing system 104 may determine that the real-time positioning of the second aircraft 310 positions the second aircraft 310 between the same four nodes as the position of the first aircraft 308. In such case, the second aircraft 310 is re-assigned to segment 402-1, and a determination is made that the second aircraft 310 has entered the first taxiway 306-1. As a result, a determination is made that a potential conflict may exist on the first taxiway 306-1.

Figure 6:
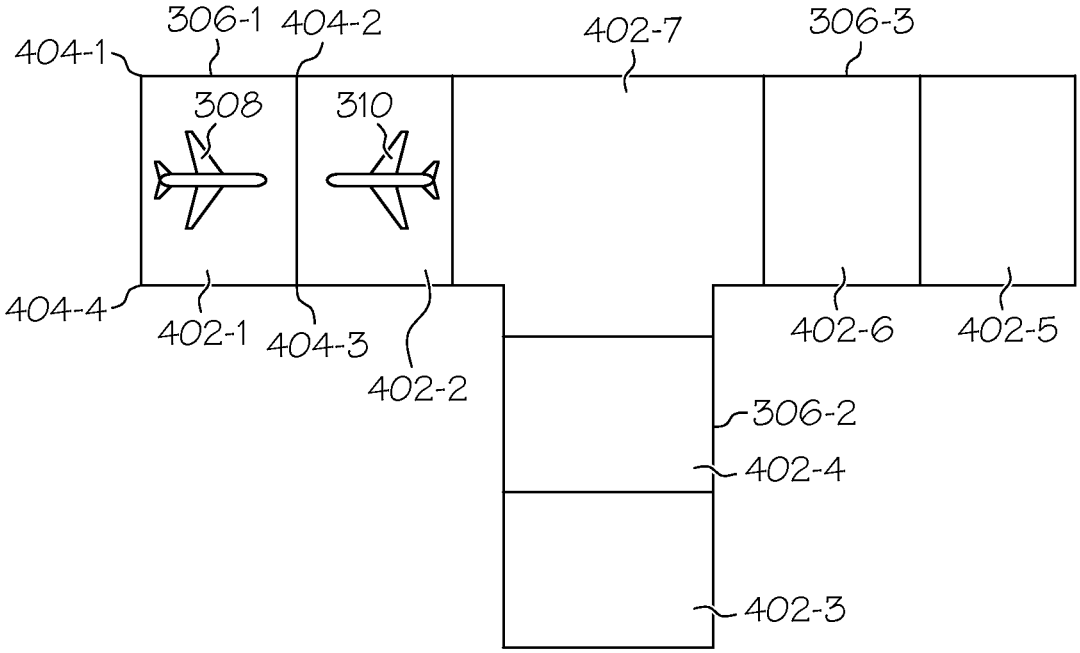
FIG. 6 is a simplified representation of two aircraft and a plurality of taxiways, according to another embodiment.

In still another embodiment, a prediction may be made that the second aircraft 310 will enter the first taxiway 306-1, when the monitored real-time positioning data of the second aircraft 310 indicates that the first aircraft 308 and the second aircraft 310 occupy adjacent segments. For example, the processing system 104 may determine that the segment assigned to the first aircraft 308 and the segment assigned to the second aircraft 310 have two nodes in common. In such case, the segment 402-2 adjacent the segment 402-1 assigned to the first aircraft 308 is then assigned to the second aircraft 310, as shown in FIG. 6. If the processing system 104 determines that the occupation of the second aircraft 310 on the adjacent segment 402-2 prevents the first aircraft 308 from having at least one egress from the first taxiway 306-1, then a determination is made that a potential conflict may exist on the first taxiway 306-1.

Figure 7:
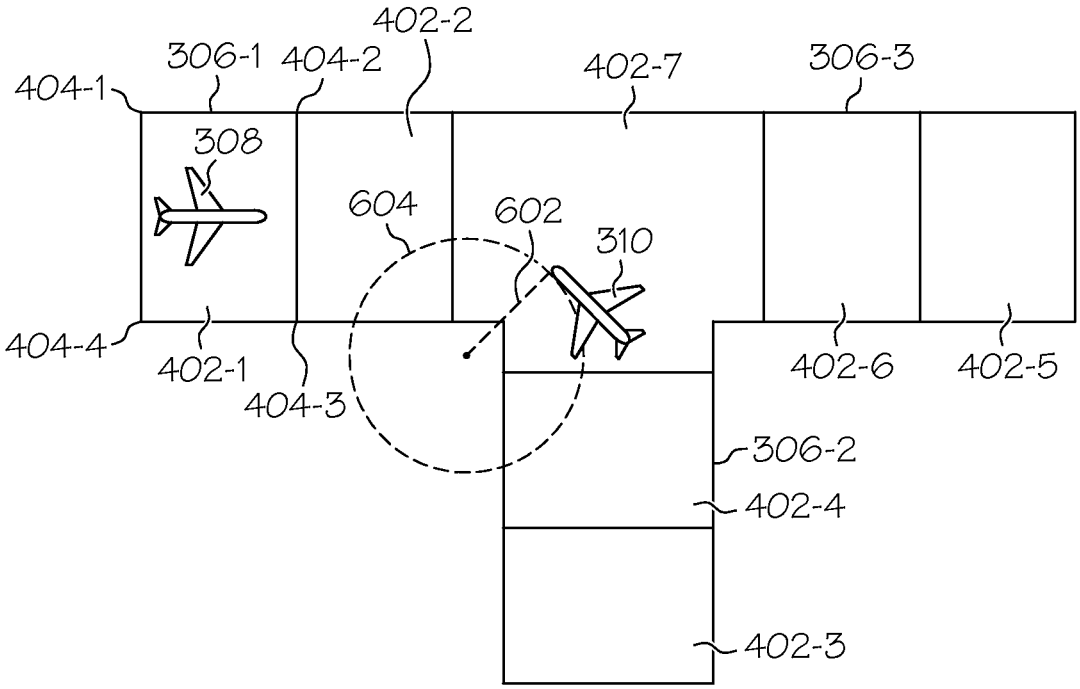
FIG. 7 is a simplified representation of two aircraft and a plurality of taxiways, according to still another embodiment.

In still yet another embodiment, a prediction may be made that the second aircraft 310 will enter the first taxiway 306-1, when the monitored real-time positioning data of the second aircraft 310 indicates the second aircraft 310 is on a predicted path toward a segment on which the first aircraft 308 is located. In an example, the processing system 104 may determine that the monitored data indicates the second aircraft 310 is currently occupying the second taxiway 306-2, but is in the process of turning onto the first taxiway 306-1, as shown in FIG. 7. In this embodiment, the processing system 104 may calculate a turning radius 602, based on the monitored real-time positioning data of the second aircraft 310. It will be appreciated that because the real-time positioning data of the second aircraft 310 is dynamic, the calculated turning radius 602 may change from instant to instant. Thus, the processing system 104 may use each calculated turning radius 602 to project one or more predicted paths 604 of the second aircraft 310, and the predicted path may be used to determine whether a potential conflict exists on the first taxiway 306-1.

In an embodiment, if one of the predicted paths 604 shows the second aircraft 310 will travel along the first taxiway 306-1, then a segment of the first taxiway 306-1 closest to the second aircraft 310 is assigned thereto. After comparing the segment assigned to the second aircraft 310 with that of the first aircraft 308, if the segment assigned to the second aircraft 310 is the same segment as that associated with the first aircraft 308 or is a segment that prevents the first aircraft 308 from having at least one egress from the first taxiway 306-1, then a determination is made that a potential conflict may exist thereon.

The potential conflict is then depicted on the first taxiway 306-1 to thereby alert the user 109 thereof, step 508. In an embodiment, the processing system 104 may supply one or more image rendering commands to the display 112 to visually indicate the potential conflict on the first taxiway 306-1. For example, the processing system 104 may supply commands to change one or more segments 402 on the first taxiway 306-1 from a first appearance to a second appearance. The segment 402-1 may change from a first color to a second color. In an embodiment, the first color may be a universally known neutral color (such as green) or may appear not to be colored, and the second color may be a universally known warning or cautionary color, such as amber. In other instances, the first color may be a universally known warning or cautionary color, such as amber, and the second color may be an alert color such as red. In another embodiment, the segment 402-1 may change from a solid appearance to a flashing appearance.

Methods and systems have been provided that can be used to display runways, taxiways, and/or apron elements, and that can provide sufficient position and/or orientation information to the flight crew. The methods and systems may be used to indicate whether a potential conflict exists on a taxiway between the positions of two aircraft.

While at least one exemplary embodiment has been presented in the foregoing detailed description of the inventive subject matter, it should be appreciated that a vast number of variations exist. It should also be appreciated that the exemplary embodiment or exemplary embodiments are only examples, and are not intended to limit the scope, applicability, or configuration of the inventive subject matter in any way. Rather, the foregoing detailed description will provide those skilled in the art with a convenient road map for implementing an exemplary embodiment of the inventive subject matter. It being understood that various changes may be made in the function and arrangement of elements described in an exemplary embodiment without departing from the scope of the inventive subject matter as set forth in the appended claims.

What is claimed is:

1. A method for alerting an aircraft crew member of a potential conflict between a first aircraft and a second aircraft on a first taxiway, the method comprising the steps of:

supplying, to a processor disposed in the first aircraft, data related to real-time positioning the first aircraft on the first taxiway;

transmitting, from the second aircraft to the first aircraft, data related to real-time positioning of the second aircraft;

supplying, to the processor, the data related to real-time positioning of the second aircraft;

processing, in the processor, the data related to real-time positioning of the second aircraft, to predict whether the second aircraft will enter the first taxiway, and supplying display commands to a display disposed in the first aircraft that cause the display to render the first taxiway as a plurality of segments and, if the processor predicts that the second aircraft will enter the first taxiway, that cause the display to change an appearance of the segment of the first taxiway on which the first aircraft is located.

2. The method of claim 1, wherein the step of transmitting comprises transmitting from an automatic dependent surveillance broadcast transmitter disposed in the second aircraft.

3. The method of claim 1, wherein the method further comprises:

processing the data related to real-time positioning the first aircraft to identify the segment on which the first aircraft is located;

processing data related to real-time positioning the second aircraft to identify the segment on which the second aircraft is positioned;

comparing, in the processor, the segment on which the first aircraft is located and the segment on which the second aircraft is positioned; and predicting that the potential conflict exists, when the segment on which the first aircraft is located and the segment on which the second aircraft is positioned are located relative to each other such that the first aircraft is not provided with an egress from the first taxiway.

4. The method of claim 1, wherein the step of processing comprises:

calculating a turning radius of the second aircraft from the real-time positioning data of the second aircraft;

projecting a predicted path of the second aircraft from the calculated turning radius; and predicting that the potential conflict exists, based on the predicted path.

5. The method of claim 4, wherein the method further comprises:

processing the data related to real-time positioning the first aircraft to identify the segment on which the first aircraft is located;

processing the data related to real-time positioning the second aircraft to determine whether the predicted path indicates the second aircraft will travel on the first taxiway;

if the predicted path indicates the second aircraft will travel on the first taxiway, assigning the second aircraft with a segment of the first taxiway closest to the second aircraft;

comparing the segment on which the first aircraft is located and the segment on which the second aircraft is positioned; and predicting that the potential conflict exists, when the segment on which the first aircraft is located and the segment on which the second aircraft is positioned are located relative to each other such that the first aircraft is not provided with an egress from the first taxiway.

6. The method of claim 1, wherein the segment of the first taxiway has a first color and changing the appearance of the segment comprises changing the segment of the first taxiway to a second color.

7. The method of claim 6, wherein changing the appearance comprises flashing the segment of the first taxiway.

* * * * *